United States Patent [19]

Gasser et al.

[11] 4,350,007

[45] Sep. 21, 1982

[54] SPINNING FRAME

[75] Inventors: Hermann Gasser, Zürich; Karl Curiger, Pfäffikon; Peter Novak, Winterthur, all of Switzerland

[73] Assignee: Luwa AG, Zürich, Switzerland

[21] Appl. No.: 164,066

[22] Filed: Jun. 30, 1980

[30] Foreign Application Priority Data

Jul. 6, 1979 [CH] Switzerland ..... 6333/79

[51] Int. Cl.[3] ..... D01H 11/00

[52] U.S. Cl. ..... 57/304; 19/263; 57/308; 57/315; 57/354; 57/356

[58] Field of Search ..... 57/90, 315, 304, 701, 57/305, 352–357, 308; 19/245, 262–265

[56] References Cited

U.S. PATENT DOCUMENTS

| | | | |
|---|---|---|---|
| 1,449,928 | 3/1923 | Addis | 57/356 |
| 3,070,948 | 1/1963 | Tsuzuki | 57/308 |
| 3,073,106 | 1/1963 | Tsuzuki | 57/308 |
| 3,287,768 | 11/1966 | Rakhorst | 19/263 X |
| 3,359,713 | 12/1967 | Keyser | 19/263 X |
| 3,377,665 | 4/1968 | Kincaid | 19/263 |
| 3,387,318 | 6/1968 | Nagel et al. | 19/263 X |
| 3,412,545 | 11/1968 | Lippuner | 57/304 |
| 3,564,829 | 2/1971 | Tsuzuki | 57/308 |
| 4,006,033 | 2/1977 | Schewe | 57/301 X |
| 4,107,910 | 8/1978 | Furstenberg et al. | 57/354 X |
| 4,129,979 | 12/1978 | Hamel | 57/304 X |
| 4,175,371 | 11/1979 | Gasser et al. | 57/304 |
| 4,226,077 | 10/1980 | Hilbert | 57/354 X |

*Primary Examiner*—John Petrakes

*Attorney, Agent, or Firm*—Werner W. Kleeman

[57] ABSTRACT

The spindles of a flyer spinning frame are each mounted in respective chambers which are defined by telescopically slidable rings. The lowest ring on each sleeve is sealingly fixed on a spindle rail, while the uppermost ring on each sleeve is attached to a common, vertically movable support. The chambers, which are open at the top, are connected to the suction side of a ventilating fan by ducts, which extend through the spindle rail, and by flexible lines.

22 Claims, 3 Drawing Figures

SPINNING FRAME

CROSS REFERENCE TO RELATED CASES

This application is related to the commonly assigned copending U.S. applications Ser. Nos. 06/164,067, filed June 30, 1980, 06/164,068, filed June 30, 1980, 06/164,292, filed June 30, 1980 and 06/164,321, filed June 30, 1980.

BACKGROUND OF THE INVENTION

The invention relates to a spinning frame, and particularly, though not exclusively, to a flyer spinning frame, in which the spindles are mounted in a chamber connected to the suction side of a ventilating fan.

A flyer spinning frame has been proposed in which a housing extends over the length of the frame and encloses the spindle rail, with its spindles, and the flyers. The housing communicates with the suction side of a fan, and streams of inflowing air created by the fan are supplied through orifices in the front of the housing. As a result of the frame being enclosed, and of the reduced pressure prevailing within the housing, it is possible to prevent the draught created by the flyers from expelling dust into the spinning room. However, it is not possible to prevent dust from collecting in dead zones of the chamber or for the spindles, which are adjacent to presser fingers, from being affected in the event of roving breakages.

SUMMARY OF THE INVENTION

The object of the present invention is therefore to provide a frame in which a greater proportion of the dust formed during the spinning operation can be collected.

According to the present invention there is provided a spinning frame in which each spindle is mounted in a separate chamber connected to the suction side of a source of low pressure via a spindle rail.

As each spindle has its own separate chamber, it is possible not only to design the air path through the said chamber in such a manner that hardly any dust can settle, but also to eliminate any interaction between the spindles during operation. With this arrangement it is also possible to create controlled flow conditions in the area of the spindles and thereby prevent flow losses, for example, due to turbulence, so that the driving energy required at the spindles can be reduced.

BRIEF DESCRIPTION OF THE DRAWINGS

The invention will be more clearly understood from the following description, given by way of example only, with reference to the accompanying drawings in which.

DETAILED DESCRIPTION OF THE PREFERRED EMBODIMENTS

Figure 1:
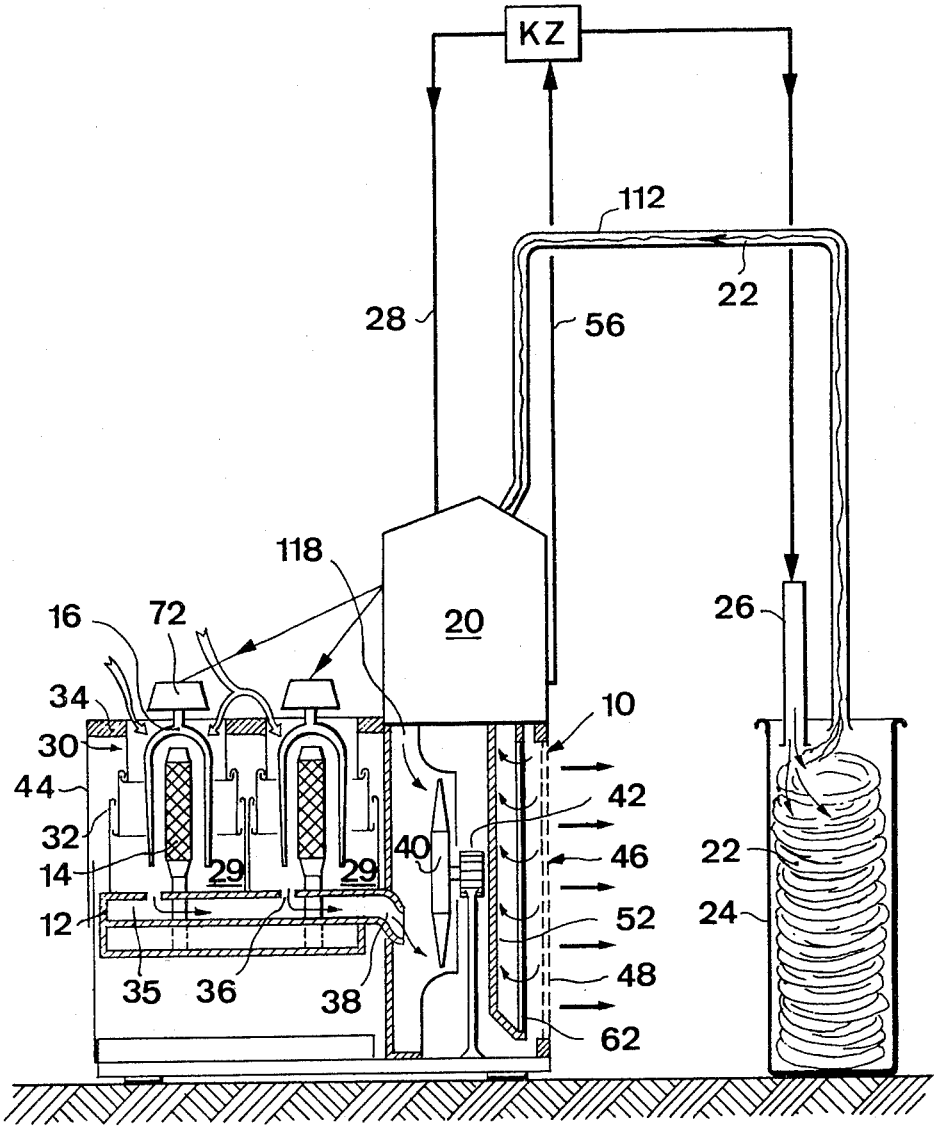
FIG. 1 shows a flyer spindle frame in diagrammatic cross-section.
Figure 3:
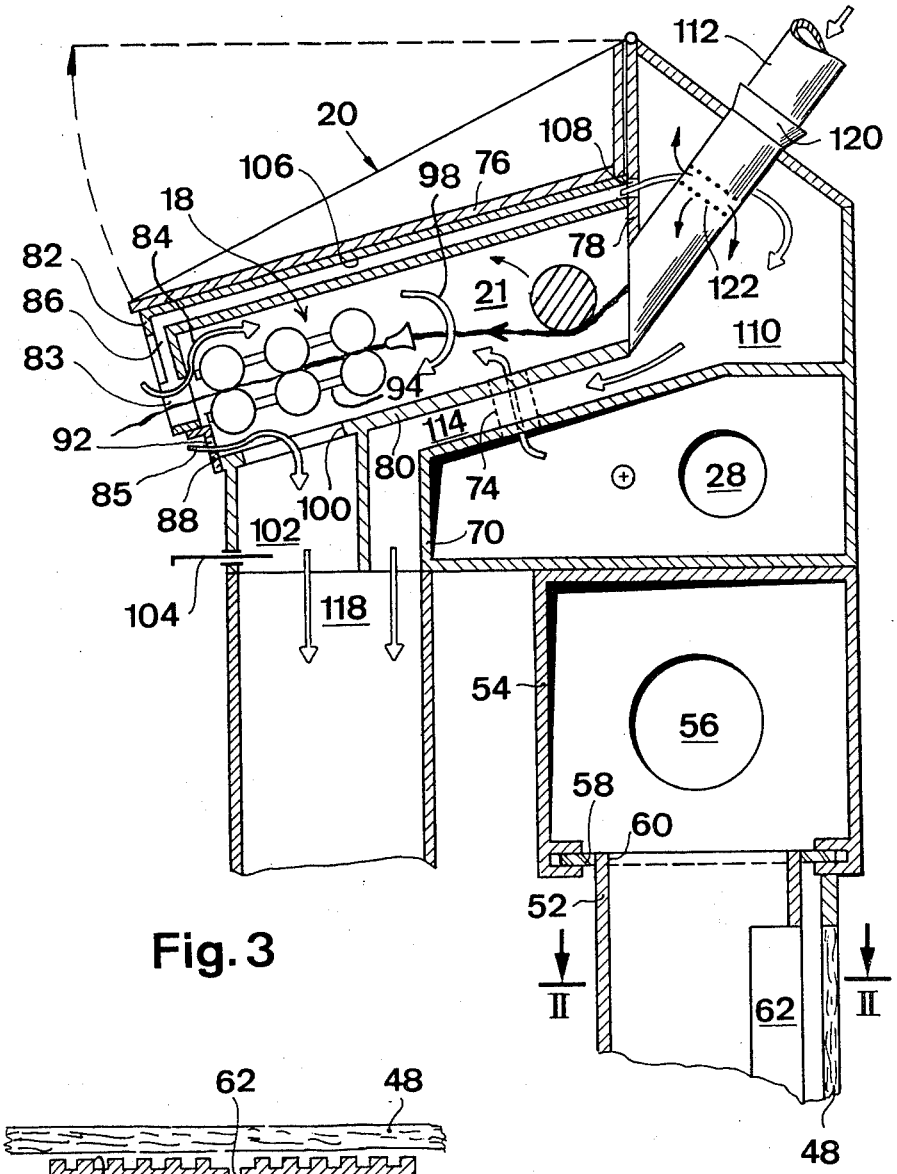
FIG. 3 shows, on an enlarged scale, part of the frame of FIG. 1.

Generally designated at 10 in FIG. 1 is a flyer spinning frame which comprises a spindle rail 12, a plurality of spindles of which two are shown at 14 and drawing rollers 18 of a drawing frame shown in FIG. 3 and located in a drawing zone generally designated at 20 in the Figures. Cans 24, one of which is shown, are filled with a draw sliver 22 to be processed. Conditioner air is fed from an air-conditioning unit KZ through pipes 26 and 28 to the cans 24 and the flyer spinning frame 10, respectively.

As shown in FIG. 1, each of the spindles 14 is arranged, together with its flyer 16, in a separate chamber or compartment 29. The chambers 29 are defined as approximately circular sleeves 30 each formed by a plurality of rings 32 which can be moved telescopically within one another. The sleeves 30 are open at the top and their axial length can be varied according to the lift of the movable spindle rail 12. The lowest ring 32 of each sleeve 30 is attached in air-tight manner to the spindle rail 12 which has a duct section 35 for each sleeve 30 or, as shown, each adjacent pair of sleeves. The upper side of the duct section 35 has an inlet orifice 36 located inside the corresponding ring 32. The duct sections in the spindle rail 12 and therefore the chambers 29, that is the sleeves 30, are in turn connected by flexible tubes 38 to the suction side of a ventilating fan 40 which is driven by a motor 42.

The rings 32 of the sleeves 30 are each secured in a common support or retaining frame 34 which is vertically movable, but which is kept stationary during operation of the flyer spinning frame 10. A telescopic covering shutter 44 extends down from the front edge of the retaining frame 34 to the spindle rail 12.

The rear wall 46 of the flyer spinning frame 10 is at least partially formed by a filter 48 which comprises a large proportion of the wall and through which air from the delivery side of the ventilating fan 40 flows into the spinning room.

Figure 2:
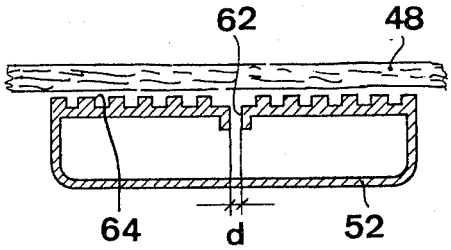
FIG. 2 is a section along line II—II in FIG. 3.

In order to remove dust and fibres from the filter 48, there are pneumatic cleaning means comprising a suction arm 52 which is movable along the inside of the filter 48. The suction arm 52 leads into an air duct 54 (FIG. 3) which extends along the flyer spinning frame 10 adjacent the rear wall 46. The air duct 54 is connected by a line 56, and preferably via a pressure reducing means, to the suction side of the air-conditioning unit KZ. Part of the bottom of the air duct 54 consists of a flexible band 58 which is movable in the longitudinal direction of the duct 54 and which covers a longitudinal slot in the bottom of the duct 54. The band 58 is reciprocated by a suitable drive (not shown). The suction arm 52 is attached to the band 58, the interior of the suction arm 52 being connected via an orifice 60 to the duct 54 for admission of air thereto. As shown in FIGS. 1 and 2, the suction arm 52 has a longitudinal suction slot 62 having a width d, this slot extending over the entire height of the filter 48. Preferably, and as shown in FIG. 2, the cross-section of the suction arm 52 is rectangular, and on both sides of the suction slot 62 and adjacent to the surface of the filter 48 there are sealing baffles 64, which cause air to flow into the suction arm through the filter 48 from its clean air side. The overall width of the suction arm 52 in its direction of movement, is preferably several times greater than d in order to achieve an effective sealing and prevent the lateral admission of suction air.

In FIG. 3 the drawing zone 20 is shown in detail and on an enlarged scale compared with FIG. 1.

Sets of drawing rollers 18, of which one is shown, are supported in a manner not shown in detail, above an air duct 70 which extends, adjacent to the rear wall 46, along the flyer spinning frame 10 at about the height of upper bearings 72 of the flyers 16. An end of this duct 70 is connected to the air-conditioning unit KZ by a pipe 28 so that conditioned air is fed to the duct 70. The drawing zone of each set of drawing rollers 18 is connected to the duct 70 by an offset duct 74 so that drawing of the fibres takes place in an air-conditioned atmosphere.

In the zone 20 is a casing 21 defined at the top by a hinged lid 76, at the rear by a wall 78 and at the bottom by the wall 80 through which the offset ducts 74 pass. The front of the casing 21 is formed by a wall section 82, which is attached to the lid 76 and which has for each sliver or roving an opening 83 which serves as an inlet orifice for admitting cleaning air to the upper drawing rollers (arrow 84). The wall section 82 also contains an inlet orifice 86 for the removal, by suction of any broken sliver or roving through an air line 106. The remaining part of the front of the casing 21 is formed by a wall 88 which can be swung forwards and downwards and which contains an inlet orifice 92 for admitting cleaning air as indicated by arrow 85 to the delivery rollers, that is the outlet rollers of the drawing frame.

Strippers associated with the drawing rollers to remove fibres therefrom, and which are not shown, are subjected to the streams of air which flow in the directions of the arrows 84, 85 and which also convey the stripped fibres. Between the drawing rollers there are provided baffles 94 which at least partly prevent the downward passage of air from the stream designated by the arrow 84 between the rollers. As a result, the greater part of the cleaning air sucked through the opening 83 passes to the rear of the casing 21, over the upper drawing rollers, round the intake rollers of the drawing frame and forward again under the lower drawing rollers, as shown by arrow 98. This cleaning air, together with the air (arrow 85) which has been admitted through the orifice 92, then flows through an orifice 100 in the wall 80 into a duct 102 which leads to the ventilating fan 40 via a duct 118. In the duct 102 there is provided an adjustable shutter 104 with which it is possible to control the quantity of air flowing therein.

For removing broken slivers or rovings by suction there is provided, in addition to the air line 106 extending through the hinged lid 76, an orifice 108 in the wall 78 of the casing, which is also a wall of a housing 110 arranged above the duct 70. The housing 110 is connected by a duct 114 to the ventilating fan 40, again via the duct 118.

Leading into the rear wall 78 of the casing 21 is a conveying tube 112 for a sliver to be processed, which leads from the can 24. It will be appreciated that the connections between the ventilating fan 40 and, firstly, the interior of the casing 21 and, secondly, the interior of the housing 110, extend initially separately from one another before being combined in duct 118 so that it is possible to set different pressures in these region, for example, to set a lower pressure in the housing 110 than in the casing 21.

Where the tube 112 enters the housing 110, there is arranged an injector 120 for feeding in the sliver. Where it extends through the housing 110, the conveying tube 112 has outlet orifices 122 for the conveying air which can therefore be at least partially removed before the sliver emerges from the conveying tube into the chamber 21.

In order to operate the flyer spinning frame 10, the draw sliver 22 is placed in the can 24 near the opening thereinto of the conveying tube 112, and the injector 120 is operated for a short period. This results in the sliver 22 being conveyed into and through the conveying tube 112 and passed as far as the intake rollers of the drawing frame 18. It can then be fed in by hand and subsequently threaded into the flyer. During operation of the frame, conditioned air passes through the pipe 26 into the can 24 so that it is possible to achieve pre-conditioning of the sliver, which helps in subsequent processing, particularly drawing. Conditioned air is also passed through the pipe 28, the duct 70 and the offset passages 74 to the drawing rollers 18 so that the most favourable conditions for processing the sliver occur also at these points. Meanwhile, the ventilating fan 40 causes the conveying air which carries the sliver from the can 24 to be sucked through the conveying tube 112, and this continually carries the sliver from the can 24 to the drawing rollers 18. It is, in fact possible to feed conditioned air only to the drawing rollers, rather than to the can as well. This has the advantage of a longer time of air residence at the drawing zone which can be particularly important in the case of higher sliver speeds and correspondingly short residence times between the drawing rollers.

The conveying air flows from the tube 112 through the orifices 122 into the housing 110, and passes through the ducts 114 and 118 to the ventilating fan 40. The air for cleaning the drawing rollers 18 flows into the casing through the openings 83 and the orifices 92 around the delivery rollers, flows around the strippers and finally passes, together with the initially conditioned air stream from the duct 114, through the duct 118 to the ventilating fan 40. The air which is sucked through the orifices 86 into the line 106 for removing broken rovings by suction also flows into the housing 110 and through the ducts 114 and 118 to the ventilating fan 40.

When the supporting or retaining frame 34 and the sleeves 30 are lowered upon filling of the bobbins, so as to allow replacement with empty bobbins, the sleeves 30 and the covering shutter 44 telescope, and the bobbins mounted on the spindles 14 become accessible. Meanwhile ambient air is still sucked from above through the sleeve 30 in the direction of the double arrows of FIG. 1. This suction air also conveys dust released from the bobbin presser, and it passes through the air-conducting elements in the spindle rail 12 to the ventilating fan 40, to be blown out therefrom into the spinning room through the filter 48. The deposit forming on the filter 48 from this and other sources is removed by the moving suction arm 52 and fed via the duct 54 and the line 56 to the air-conditioning unit KZ and collected therein.

As the filter 48 extends over a major part of the length of the frame, and over a considerable part of the rear wall, a large surface area is provided to clean the air without a significant loss of pressure. The air is ejected at a comparatively low velocity.

Although the ventilating fan 40 has been shown as associated with the frame described, where several frames are located together it is possible to provide one, or more, common low pressure sources, e.g. a single but larger low pressure fan. In such a case the filter 48 and associated cleaning devices will be replaced with a central separator associated with the common low pressure source.

While there are shown and described present preferred embodiments of the invention, it is to be distinctly understood that the invention is not limited thereto, but may be otherwise variously embodied and practiced within the scope of the following claims. Accordingly,

What we claim is:

1. A spinning frame comprising:
a spindle rail;
a plurality of spindles;
means defining a source of low pressure;
means defining a respective separate chamber for each spindle;
each said chamber being connected to a suction side of said source of low pressure by means of said spindle rail;
said chambers comprising generally circular sleeves which are variable in axial length;
each of said sleeves comprising a plurality of rings telescopically slidable within one another; and
a lowest ring of each said sleeve being sealingly connected to said spindle rail and including a vertically movable support to which an uppermost ring of each said sleeve is attached.

2. A spinning frame comprising:
a spindle rail;
a plurality of spindles supported by the spindle rail;
means defining a source of low pressure;
means defining a respective separate chamber for each spindle;
each said chamber being connected to a suction side of said source of low pressure by means of said spindle rail;
said chambers comprising generally circular sleeves which are variable in axial length;
a duct section having an orifice in said spindle rail provided for each said chamber; and
means connecting said duct sections to said source of low pressure.

3. A spinning frame comprising:
at least one spindle;
an up-and-down movable spindle rail supporting said at least one spindle;
means for winding sliver about said spindle;
means defining a wall structure surrounding said spindle and said winding means;
said wall structure being connected in a substantially airtight fashion with said up-and-down movable spindle rail;
said wall structure forming a compartment extending about said spindle;
means defining a source of suction air;
an air duct flow communicating with said source of suction air; and
said compartment flow communicating with said air duct which flow communicates with said source of suction air.

4. A frame as claimed in claim 2, wherein said source of low pressure is a fan.

5. A frame as claimed in claim 4, including, on the pressure side of said fan, a filter and pneumatic cleaning means for said filter.

6. A frame as claimed in claim 5, wherein said spinning frame has a rear wall and the filter forms at least part of said rear wall.

7. A frame as claimed in claim 5, wherein the cleaning means comprises a suction arm which is movable along the filter and a suction device connected to said suction arm.

8. A frame as claimed in claim 7, and including an air duct which is connected to said suction device and extends longitudinally adjacent a rear wall of the frame, said air duct having a longitudinally movable part to which said suction arm is connected.

9. A frame as claimed in claim 8, wherein said longitudinally movable part is a flexible band, a wall of said duct having a longitudinal slot and said band covering said slot and being guided in said duct wall.

10. A frame as claimed in claim 7 and including a longitudinal suction slot in said suction arm, and sealing baffles provided on both sides of said slot and extending towards and adjacent said filter surface.

11. A frame as claimed in claim 2 and comprising drawing rollers upstream of the spindles, a casing within which said rollers are mounted and means connecting the interior of the casing to said source of low pressure.

12. A frame as claimed in claim 11, wherein the casing has inlet orifices for admitting cleaning air to the surfaces of said drawing rollers.

13. A frame as claimed in claim 11, and further comprising a tube for conveying a sliver to be drawn, said tube extending into the said casing.

14. A frame as claimed in claim 13, and including outlet orifices in said conveying tube upstream of said casing, a housing, means connecting said housing to said source of low pressure and said housing surrounding said outlet orifices.

15. A frame as claimed in claim 14, wherein said means connecting said source of low pressure and said casing, and said means connecting said source of low pressure and said housing, extend, at least initially, separately from one another.

16. A frame as claimed in claim 14, and comprising a hinged lid connected to said casing, an air line and suction orifices for removing broken slivers in said lid and openings in said housing by which said air line is connected to said source of low pressure.

17. A frame as claimed in claim 11, including an adjustable throttle in said means connecting said casing to said source of low pressure.

18. A frame as claimed in claim 11, and comprising a hinged lid connected to said casing.

19. A frame as claimed in claim 18, and comprising, in said lid, an air line and suction orifices for removing broken slivers, said air line leading to said source of low pressure.

20. A frame as claimed in claim 11 and including a source of conditioned air to which at least the interior of said casing is connected.

21. A frame as claimed in claim 20, including a longitudinal duct connected to said source of conditioned air and passages leading from said duct to the interior of said casing.

22. A frame as claimed in claim 20 and further comprising a tube for conveying a sliver to be drawn, said tube extending into said casing, and wherein the interior of said casing is connected to said source of conditioned air by said conveying tube.

* * * * *